US005262828A

United States Patent [19]

Oka et al.

[11] Patent Number: 5,262,828

[45] Date of Patent: Nov. 16, 1993

[54] DEVELOPING BIAS POWER UNIT FOR USE IN AN IMAGE FORMING APPARATUS

[75] Inventors: Tateki Oka, Atsugi; Hiroshi Goto, Itami; Yasuo Tanaka; Tamotsu Sakuraba, both of Machida; Kazuyoshi Hara, Isehara; Hitoshi Saito, Machida; Koji Uno, Kawasaki, all of Japan

[73] Assignee: Minolta Camera Kabushiki Kaisha, Osaka, Japan

[21] Appl. No.: 987,613

[22] Filed: Dec. 9, 1992

[30] Foreign Application Priority Data

Dec. 13, 1991 [JP] Japan ..... 3-330413
May 27, 1992 [JP] Japan ..... 4-134839
Sep. 8, 1992 [JP] Japan ..... 4-239416

[51] Int. Cl.[5] ..... G03G 15/06
[52] U.S. Cl. ..... 355/265; 118/651
[58] Field of Search ..... 355/246, 265, 268; 118/651; 430/100, 103

[56] References Cited

U.S. PATENT DOCUMENTS 3,866,574 2/1975 Hardennrook et al. ..... 118/647
4,350,749 9/1982 Ohnuma et al. ..... 430/100
4,395,476 7/1983 Kanbe et al. ..... 430/102
4,984,022 1/1991 Matsushita et al. ..... 355/246

FOREIGN PATENT DOCUMENTS 60-107052 6/1985 Japan ..... 355/268

*Primary Examiner*—Joan H. Pendegrass
*Attorney, Agent, or Firm*—Willian Brinks Olds Hofer Gilson & Lione

[57] ABSTRACT

An image forming apparatus accommodates a developing bias power unit for applying a bias voltage to a developing sleeve confronting a photosensitive member. The developing bias power unit includes a DC power source, an electricity storage element interposed between the DC power source and the developing sleeve, and a controller for on-off controlling the DC power source. When an output of the DC power source is activated, the electricity storage element is electrically charged by an output voltage of the DC power source, and a first voltage is applied to the developing sleeve. In contrast, when the output of the DC power source is deactivated, a second voltage of reverse polarity is applied to the developing sleeve by electric charge held in the electricity storage element.

19 Claims, 4 Drawing Sheets

DEVELOPING BIAS POWER UNIT FOR USE IN AN IMAGE FORMING APPARATUS

BACKGROUND OF THE INVENTION

1. Field of the Invention

The present invention relates generally to an electrophotographic image forming apparatus such as, for example, a copier or a printer, and more particularly to a developing bias power unit for applying a bias voltage to a developing sleeve which confronts a photosensitive member and supplies it with toner.

2. Description of the Prior Art

FIG. 1 schematically depicts a conventional developing bias power unit 104 for use in a reversaldevelopment type image forming apparatus 100. As shown in FIG. 2, the peripheral surface of a photosensitive member 101 is electrostatically charged at a predetermined voltage Vo, and the surface voltage of an area B on the photosensitive member 101 between respective image areas A and A' on the neighboring pages (which area B is hereinafter referred to as an inter-image area) is reduced to Vo' by illuminating the inter-image area B. The illumination of the inter-image area B is carried out by forcibly emitting a laser beam to regulate the intensity of the laser beam on the inter-image area B. Accordingly, the illumination of the inter-image area B does not aim at reducing the surface potential of the inter-image area B, but the surface potential of the inter-image area B is reduced to Vo' as a result of the forcible emission of the laser beam.

On the other hand, in a developing unit 102 for supplying the photosensitive member 101 with toner, a developing sleeve 103 confronting the photosensitive member 101 is connected with the developing bias power unit 104. When the developing sleeve 103 confronts one of the image areas A and A', a predetermined developing bias voltage $V_B$ is applied thereto by the developing bias power unit 104 to prevent the toner from adhering to a background area. When the developing sleeve 103 confronts the inter-image area B, no signal is output from the developing bias power unit 104 (developing bias voltage $V_B'=0V$), thereby preventing toner adhesion to the inter-image area B.

However, the mere switching of the developing bias voltage $V_B'$ over to 0V at the time the developing sleeve 103 confronts the inter-image area B results in only a voltage difference Vo' between the photosensitive member 101 and the developing sleeve 103. The voltage difference of this magnitude is not enough to prevent the toner adhesion to the inter-image area B.

Particularly, in a so-called contact-transfer type image forming apparatus wherein toner is transferred on a transfer material while the transfer material is sandwiched between the photosensitive member 101 and a transfer roller and is conveyed by the rotation thereof, if the toner adheres to the inter-image area B, the problem arises that the toner may be transferred to the transfer roller, or the toner adhering to the transfer roller may be transferred to and spoils the rear surface of the transfer material.

Prior to a printing operation, neither the developing sleeve 103 nor the photosensitive member 101 is electrostatically charged (0V), and there is no voltage difference therebetween. However, toner may adhere, more or less, to an uncharged area of the photosensitive member 101 that confronts the developing sleeve 103, because, prior to the printing operation, such an uncharged area is in contact with the toner at a nipping portion defined between the photosensitive member 101 and the developing sleeve 103. After the printing operation has been triggered and when the photosensitive member 101 starts rotating, an uncharged portion thereof lying between a charging region and a developing region is also in contact with the toner at the nipping portion. Because of this, even if there is no voltage difference between the photosensitive member 101 and the developing sleeve 103, the problem arises that the toner may adhere to such an uncharged portion to some extent.

SUMMARY OF THE INVENTION

The present invention has been developed to overcome the above-described disadvantages.

It is accordingly an object of the present invention to provide an improved developing bias power unit capable of preventing undesired toner adhesion to an uncharged portion of a photosensitive member.

In accomplishing the above and other objects, the developing bias power unit according to the present invention comprises a DC power source, an electricity storage element interposed between the DC power source and a developing sleeve, and a first control means for on-off controlling the DC power source. When an output of the DC power source is activated, the electricity storage element is electrically charged by an output voltage of the DC power source, and a first voltage is applied to the developing sleeve. In contrast, when the output of the DC power source is deactivated, a second voltage of reverse polarity is applied to the developing sleeve by electric charge held in the electricity storage element.

Preferably, the developing bias power unit further comprises a second control means for controlling so that, prior to a driving operation of the image forming apparatus, the DC power source is turned on for a given period of time, thereby electrically charging the electricity storage element. After the driving operation of the image forming apparatus, the second control means controls so that the electric charge held in the electricity storage element is discharged therefrom.

Advantageously, the developing bias power unit further comprises a third control means for controlling so that the output voltage of the DC power source applied to the developing sleeve prior to the driving operation of the image forming apparatus differs from that applied to the developing sleeve at the time the developing sleeve confronts a first image region after the driving operation of the image forming apparatus is started.

The Developing bias power unit having the above-described construction operates as follows.

The output of the DC power source is activated for the given period of time before the photosensitive member or the developing sleeve starts rotating. At this moment, a predetermined developing bias voltage reduced by a first voltage divider is applied to the developing sleeve, and the electricity storage element is charged with electricity. When the DC power source is turned off, another developing bias voltage of reverse polarity is applied to the developing sleeve by electric charge held in the electricity storage element. Accordingly, even after the photosensitive member or the developing sleeve starts rotating, a sufficient developing bias voltage is held between the developing sleeve and un uncharged region on the photosensitive member, i.e., an area lying between a charging region and a developing region, thereby preventing undesired toner adhesion to the uncharged region.

BRIEF DESCRIPTION OF THE DRAWINGS

The above and other objects and features of the present invention will become more apparent from the following description of a preferred embodiment thereof with reference to the accompanying drawings, throughout which like parts are designated by like reference numerals, and wherein:

FIG. 5 is waveform charts indicating a relationship between the surface voltage of the photosensitive member or the developing bias voltage and a developing bias remote signal input to a bias power source and the like;

DETAILED DESCRIPTION OF THE PREFERRED EMBODIMENTS

Figure 1:
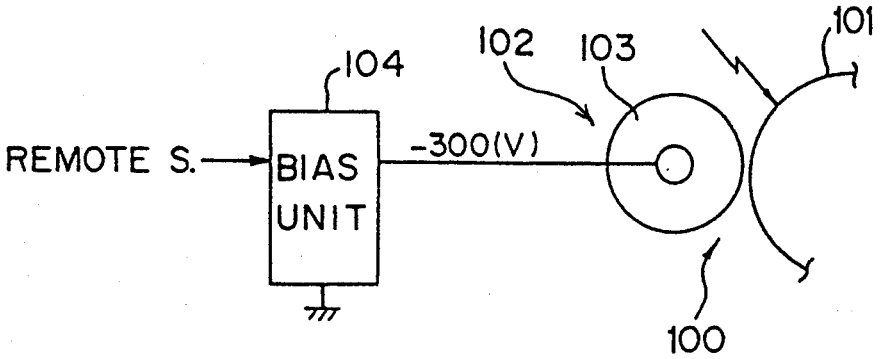
Fig. 1 PRIOR ART
FIG. 1 is a schematic circuit diagram of a conventional developing bias power unit.
Figure 2:
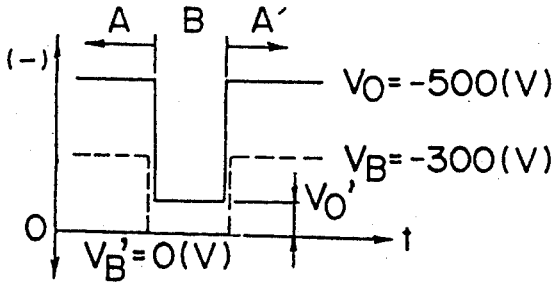
Fig. 2 PRIOR ART
FIG. 2 is a graph indicating a relationship between the surface voltage of a photosensitive member and the developing bias voltage in applications where the developing bias power unit of FIG. 1 is used.
Figure 3:
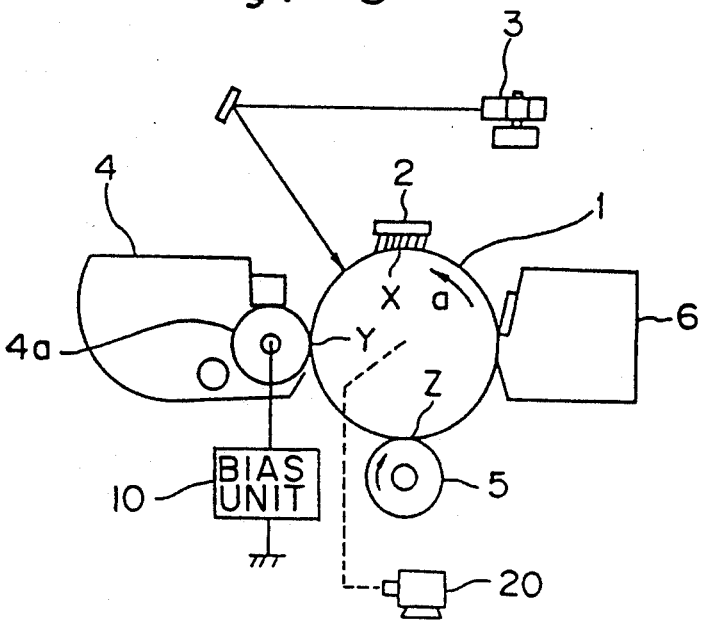
FIG. 3 is a schematic view of an image forming apparatus accommodating a developing bias power unit according to the present invention.

Referring now to the drawings, there is schematically shown in FIG. 3 an image forming apparatus accommodating a developing bias power unit 10 according to the present invention. A photosensitive member 1 has a photosensitive layer formed on an outer periphery thereof and is driven by a main motor 20 to rotate in a direction shown by an arrow (a). A charger unit 2 electrostatically charges the photosensitive layer of the photosensitive member 1 at a predetermined voltage (Vo) at a region X (this region is hereinafter referred to as a charging region). An optical unit 3 emits a laser to expose the charged photosensitive member 1, thereby forming an electrostatic latent image on an image area A or A' or reducing the voltage of an interimage area B between these image areas A and A'. A developing unit 4 supplies the electrostatic latent image on the photosensitive member 1 with toner at a region Y (this region is hereinafter referred to as a developing region). At the developing region Y, a developing sleeve 4*a* accommodated in the developing unit 4 confronts the photosensitive member 1, and a predetermined developing bias voltage $V_B$ is applied thereto by the developing bias power unit 10. A transfer roller 5 is in pressure contact with the photosensitive member 1 at a region Z (this region is hereinafter referred to as a transfer region) and is driven by the rotation of the photosensitive member 1. A cleaning unit 6 collects unused toner from the photosensitive member 1.

Figure 4:
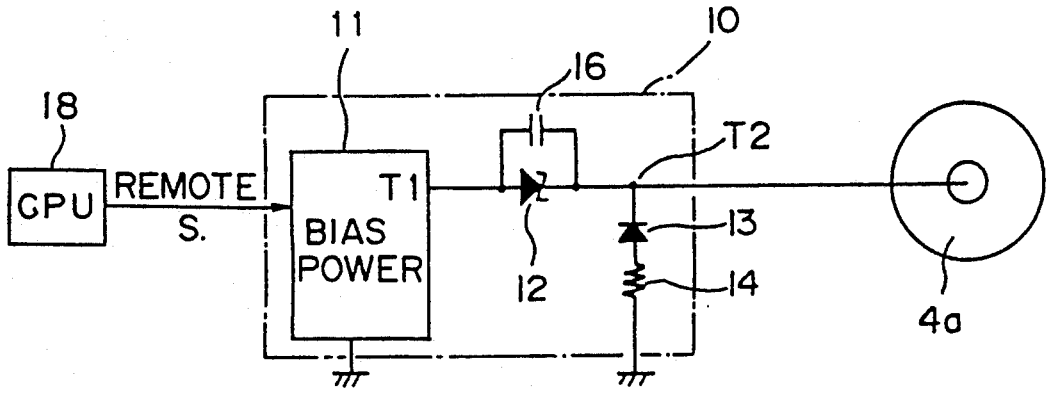
FIG. 4 is a schematic circuit diagram of the developing bias power unit according to the present invention.

As shown in FIG. 4, the developing bias power unit 10 has a DC bias power source 11, and an output portion T1 of the DC bias power source 11 is grounded via a Zener diode 12, a diode 13, and a resistor 14. The Zener diode 12 serves as a first voltage divider, whereas the resistor 14 serves as a second voltage divider. The Zener diode 12 is connected at its output side T2 with the developing sleeve 4*a*. A capacitor 16 is connected in parallel with the Zener diode 12.

In the image forming apparatus having the above-described construction, the photosensitive member 1 is rotated by the main motor 20 in the direction of the arrow (a), and the photosensitive layer thereof is charged at a predetermined voltage (Vo = −500 V) by the charger unit 2 at the charging region X. Thereafter, application of a laser by the optical unit 3 results in a formation of an electrostatic latent image on each of the image regions A and A' and a reduction of the voltage of the inter-image area B to a predetermined voltage. The electrostatic latent image is supplied with toner with negative electric charge from the developing sleeve 4*a* of the developing unit 4 at the developing region Y, and is made visible as a toner image. At the transfer region Z, the toner image is transferred on a transfer material (not shown), which is sandwiched between and is conveyed by the photosensitive member 1 and the transfer roller 5. After the toner of the toner image transferred on the transfer material has been fixed by a fixing unit (not shown), the transfer material is discharged on a suitable transfer material receiving unit (not shown). The cleaning unit 6 removes the remaining toner from the photosensitive member 1 after the photosensitive member 1 has passed the transfer region Z.

Figure 5:
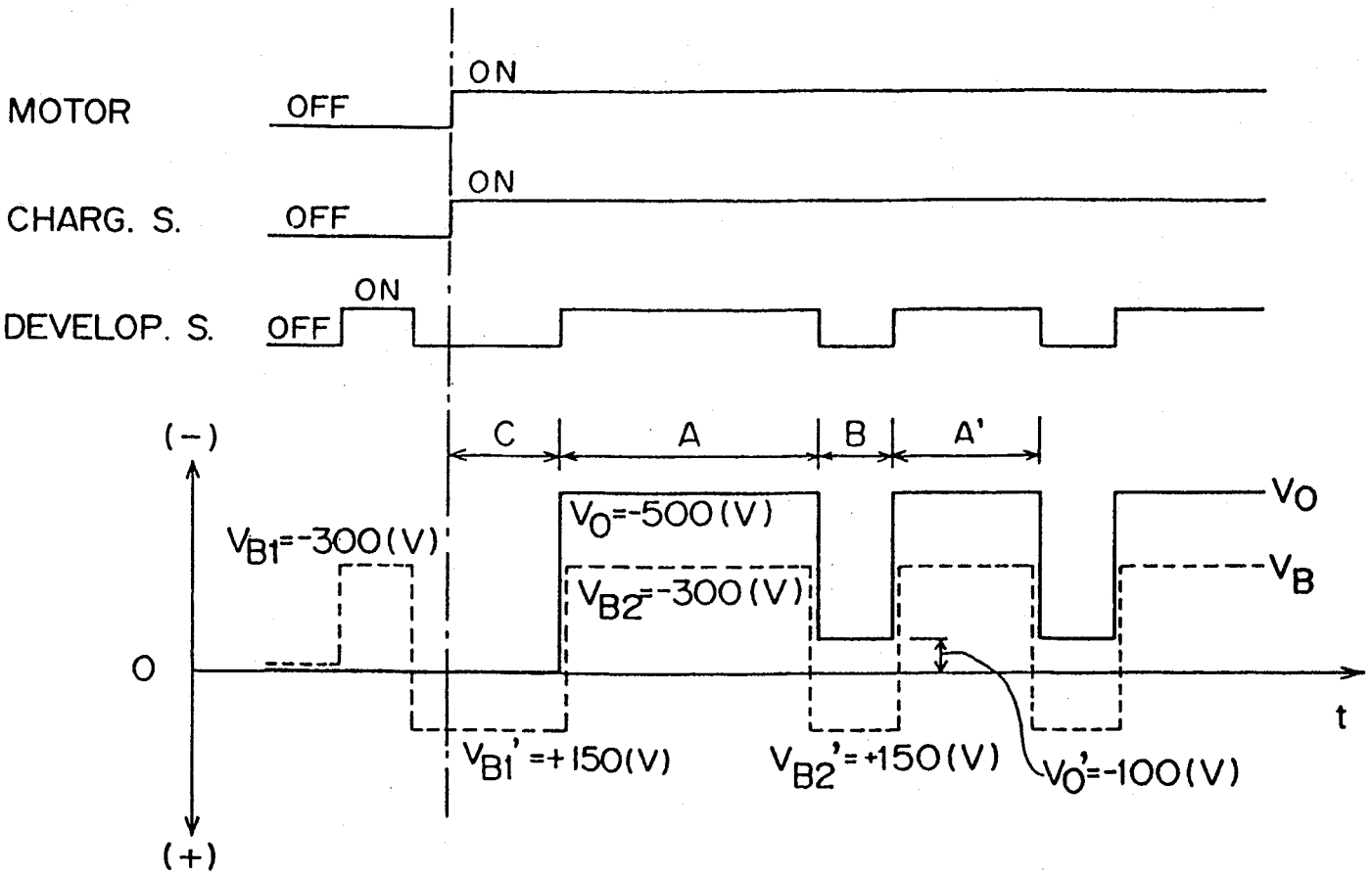

As shown in FIG. 5, upon input of a print start signal, a developing bias remote signal output from a controller 18 is input to the bias power source 11 of the developing bias power unit 10. When the bias power source 11 receives the developing bias remote signal, the bias power source 11 outputs a DC current from the output portion T1 thereof at a voltage of −450 V . The output voltage (−450 V) is reduced by the Zener diode 12, and a developing bias voltage $V_{B1}$ of −300 V is applied to the developing sleeve 4*a*. The capacitor 16 is charged with electricity until a voltage equal to a voltage difference of 150 V between input and output terminals of the Zener diode 12 is obtained.

When the developing bias remote signal is deactivated, a developing bias voltage $V_{B1}'$ of +150 V of reverse polarity is applied to the developing sleeve 4*a* by the charged capacitor 16. The developing bias remote signal may be deactivated prior to the start of the main motor 20 or at the same timing as the latter.

At the same time as the main motor 20 is turned on, a charging bias remote signal is activated, and the photosensitive layer passing the charging region X is charged at Vo = −500 V. However, a region lying between the charging region X and the developing region Y is left uncharged (this region is hereinafter referred to as an uncharged region C). Accordingly, the uncharged region C, i.e., the region having a voltage of 0V initially advances into the developing region Y. At this moment, because the developing bias voltage $V_{B1}' = +150$ V of reverse polarity is applied to the developing sleeve 4*a*, the potential of the uncharged region C is 150 V lower than that of the developing sleeve 4*a*. Because of this, toner with negative electric charge held on the developing sleeve 4*a* electrically repulses the photosensitive member 1, and never adheres to the uncharged region C of the photosensitive member 1.

The Zener diode 12 and the diode 13 prevents leakage of electric charge held in the capacitor 16. When the bias power source 11 is turned off, the voltage of the developing sleeve 4a is gradually reduced. The reduction in voltage of the developing sleeve 4a holds considerably long because a time constant is about 8.3 seconds. Accordingly, the leakage of electric charge or the reduction in voltage of the developing sleeve 4a introduces no problems in preventing the toner adhesion to the photosensitive member 1.

After the uncharged region C of the photosensitive member 1 has passed the developing region Y and when an image region A newly charged at $Vo=-500$ V by the charger unit 2 reaches the developing region Y, the developing bias remote signal is activated, and a developing bias voltage $V_{B2}$ of $-300$ V is applied to the developing sleeve 4a, thereby preventing the toner adhesion to the background area. While the developing bias remote signal is on, the capacitor 16 is charged with electricity.

After the image region A has passed the developing region Y and when the inter-image area B between respective image areas A and A' on the neighboring pages reaches the developing region Y, the developing bias remote signal is deactivated. As a result, a developing bias voltage of $V_{B2}'=+150$ V is applied to the developing sleeve 4a in the presence of the electric charge in the capacitor 16. At this stage, the voltage of the inter-image area B on the photosensitive member 1 is reduced to $Vo'=-100$ V by the application of the laser. Because the voltage of the inter-image area B is 250 V lower than that of the developing sleeve 4a, the toner with negative electric charge held on the developing sleeve 4a never adheres to the inter-image area B on the photosensitive member 1.

After the inter-image area B has passed the developing region Y and when the image region A' of the next page reaches the developing region Y, the developing bias remote signal is activated, as is the case with the image region A. At this moment, the developing bias voltage $V_{B2}$ is switched over to $-300$ V, thereby preventing the toner adhesion to the background area.

Figure 6:
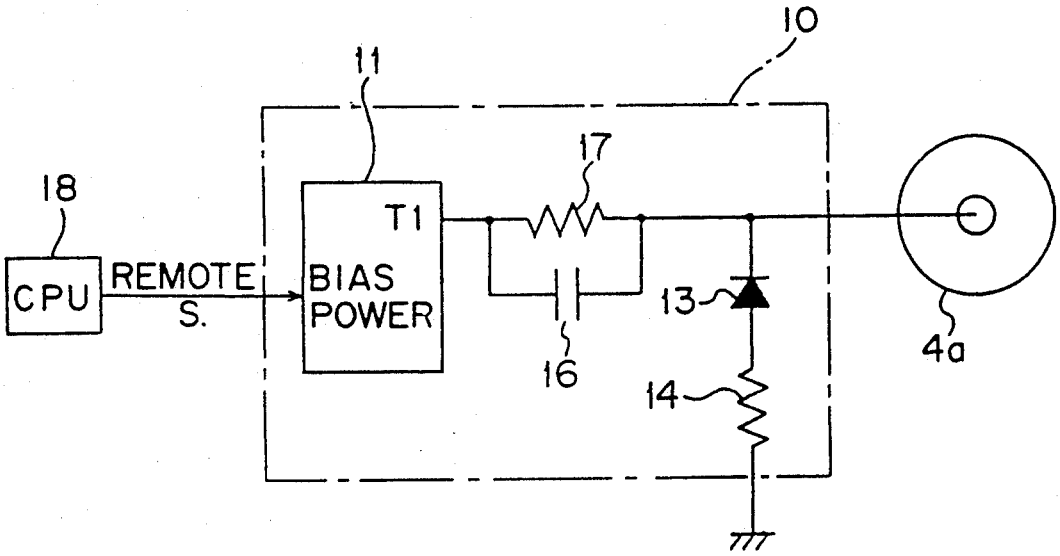
FIG. 6 is a diagram similar to FIG. 4, but indicating a modification thereof.

In the above-described embodiment, although the Zener diode 12 is used as the first voltage divider, a resistor 17 may be used in place thereof, as shown in FIG. 6. The diode 13 is not always required. Also in this case, while the developing bias remote signal is activated, each of the predetermined developing bias voltages $V_{B1}$ and $V_{B2}$ is applied to the developing sleeve 4a. Furthermore, while the developing bias remote signal is off, each of the developing bias voltages $V_{B1}'$ and $V_{B2}'$ of reverse polarity is applied to the developing sleeve 4a. In addition, because the time constant is sufficiently long, a reduction in developing bias voltage $V_{B1}'$ or $V_{B2}'$ at the time the developing bias signal is off introduces no problems.

Although the developing bias voltages $V_{B1}$ and $V_{B2}$ are made identical before and after the main motor 20 is turned on, these voltages are not always required to be identical. A higher $V_{B1}$ not only can shorten the time required for charging the capacitor 16, but also can reduce the waiting period for printing. However, if $V_{B1}$ is far higher than $V_{B2}$, toner scatters and adheres to the photosensitive member 1 at the location where developer is in contact with the photosensitive member 1. In particular, if the scattering toner adheres to the photosensitive member 1 at a location downstream from the contact portion, it is likely that such toner is transferred to the transfer roller 5 or toner adhering thereto is transferred to the rear surface of a transfer material, thereby spoiling the transfer material. In contrast, if $V_{B1}$ is far lower than $V_{B2}$, the charging of the capacitor 16 takes a lot of time, and therefore, the waiting period becomes long. In view of the above, it is necessary to determine the magnitude of each of the developing bias voltages $V_{B1}$ and $V_{B2}$.

Figure 7:
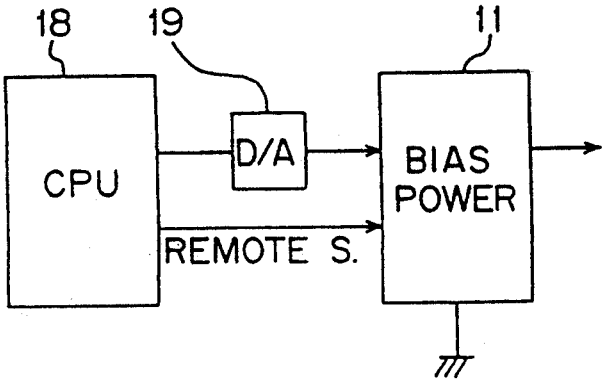
FIG. 7 is a schematic circuit diagram for changing the magnitude of the developing bias voltage.

FIG. 7 schematically depicts a circuit diagram for changing the magnitude of the developing bias voltages $V_{B1}$ to $V_{B2}$. In FIG. 7, a D/A converter 19 is interposed between a controller (CPU) 18 and a developing bias power source 11. The controller 18 outputs an output voltage regulating signal to the D/A converter 19 and changes an output from the bias power source 11 based on the output voltage regulating signal.

In the above-described embodiment, although the off-timing of the developing bias remote signal is determined based on the time when a driving operation of the main motor 20 is started, such determination may be based on the time when a driving operation of the developing sleeve 4a is started. In this case, the developing bias remote signal may be deactivated at or before this timing. It, however, is necessary to deactivate the remote signal of the developing bias voltage $V_{B1}$ before the toner held on the developing sleeve 4a is moved relative to the photosensitive member 1 by the rotation of the photosensitive member 1 or the developing sleeve 4a.

Figure 8:
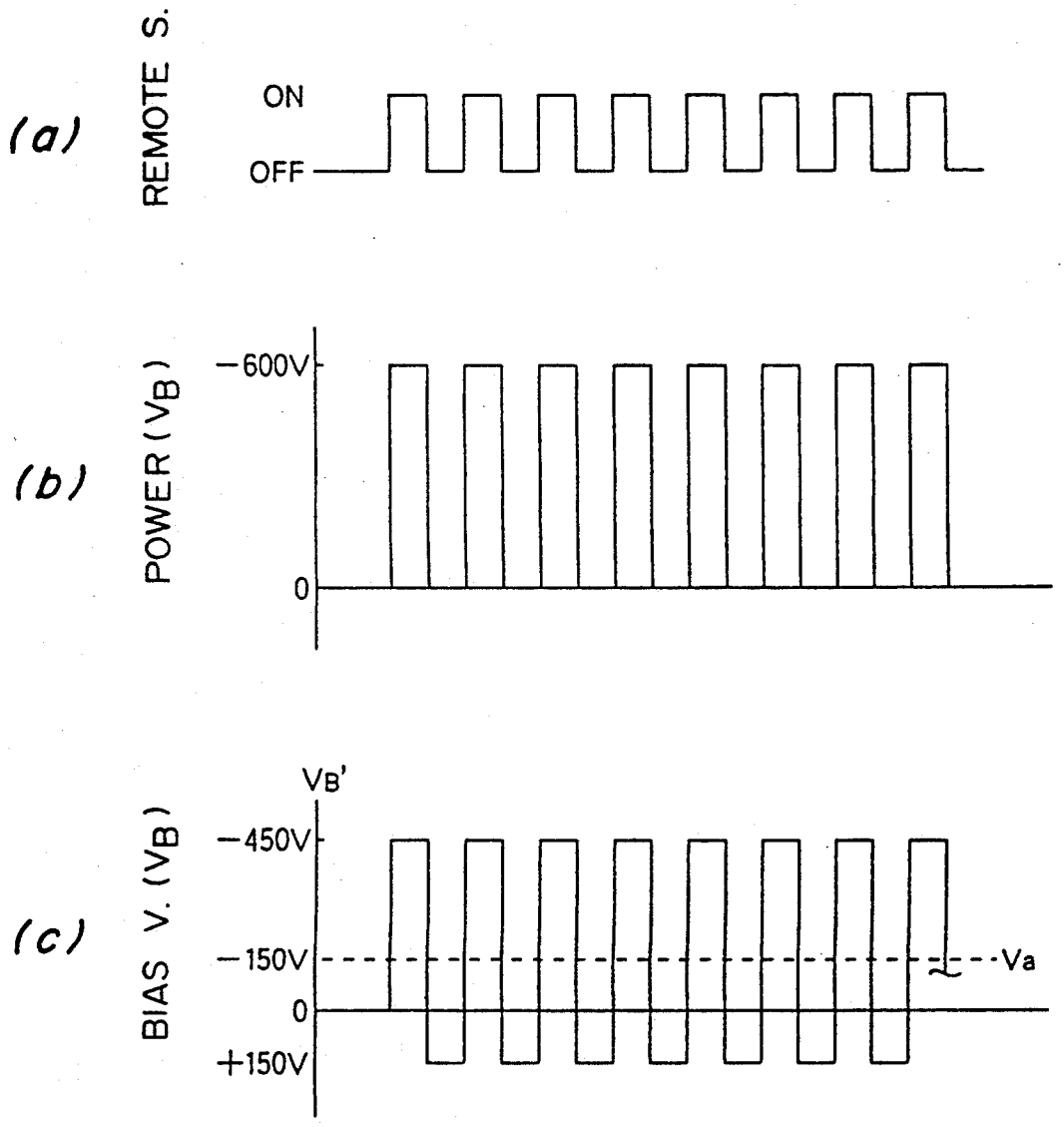
FIGS. 8(*a*) to 8(*c*) are alternative waveform charts indicating a relationship among the bias remote signal, an output voltage from the bias power source, and the developing bias voltage.

FIG. 8 depicts alternative waveform charts of the bias remote signal input to the bias power source 11, the output voltage therefrom, and the developing bias voltage.

As shown by (a), the bias remote signal is a pulse signal periodically repeating on and off. When the photosensitive member 1 is driven by the main motor 20, the bias remote signal is input to the bias power source 11. When the bias remote signal is on, a voltage of $V_B=-600$ V is output from the bias power source 11, as shown by (b), and a developing bias voltage of $V_B'=-450$ V is applied to the developing sleeve 4a by the operation of the Zener diode 12, as shown by (c). The capacitor 16 is charged with electricity by the application of a voltage equal to a voltage difference of 150 V between input and output terminals of the Zener diode 12.

When the bias remote signal is off, the output voltage $V_B$ of the bias power source 11 becomes 0V. At this moment, a developing bias voltage of $V_B'=+150$ V of reverse polarity is applied to the developing sleeve 4a by the charged capacitor 16. In short, a voltage of $-450$ V and a voltage of $+150$ V are alternately applied to the developing sleeve 4a, as shown by (c) in FIG. 8. Accordingly, an alternating bias voltage having an average voltage of $Va=-150$ V and an amplitude of 600 V is applied to the developing sleeve 4a. The application of such an alternating bias voltage results in an effective development.

As is clear from the above, according to the developing bias power unit of the present invention, before the developing sleeve or the photosensitive member starts rotating, the capacitor is electrically charged. At the time the rotation of the developing sleeve or the photosensitive member is started, a developing bias voltage of reverse polarity is already applied to the developing sleeve 4a. Accordingly, even when an uncharged region of the photosensitive member lying between the charging region and the developing region passes the developing unit, the developing bias voltage of reverse polarity prevents toner from adhering to the uncharged region.

Furthermore, even when an inter-image area on the photosensitive member between neighboring image areas passes the developing region, the developing bias voltage of reverse polarity is applied to the developing sleeve by the capacitor after the bias power source has been turned off. As a result, a sufficient voltage is held between the inter-image area and the developing sleeve, thereby reliably preventing the toner adhesion to the inter-image area.

The developing bias power unit according to the present invention requires neither a developing bias power source capable of providing an output of positive polarity and that of negative polarity nor a mechanism for switching these outputs.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A developing bias power unit for use in an image forming apparatus accommodating a photosensitive member, said developing bias power unit applying a bias voltage to a developing sleeve confronting the photosensitive member; said developing bias power unit comprising:

a DC power source;

an electricity storage element interposed between said DC power source and said developing sleeve; and a first control means for on-off controlling said DC power source so that, when an output of said DC power source is activated, said electricity storage element is electrically charged by an output voltage of said DC power source, and a first voltage is applied to said developing sleeve, and when the output of said DC power source is deactivated, a second voltage of reverse polarity is applied to said developing sleeve by electric charge held in said electricity storage element.

2. The developing bias power unit according to claim 1, wherein said first control means controls said DC power source so that, when said developing sleeve confronts a first image region on said photosensitive member, said first voltage is applied to said developing sleeve, and when said developing sleeve confronts an area between said first image region and a second image region neighboring said first image region, said second voltage is applied to said developing sleeve.

3. The developing bias power unit according to claim 1, wherein said second voltage is equal to a voltage difference between said output voltage of said DC power source and said first voltage.

4. The developing bias power unit according to claim 1, wherein said electricity storage element comprises a capacitor.

5. The developing bias power unit according to claim 4, wherein said capacitor is connected in parallel with a first resistor interposed between said DC power source and said developing sleeve.

6. The developing bias power unit according to claim 5, wherein said first resistor comprises a Zener diode.

7. The developing bias power unit according to claim 6, wherein an output side of said first resistor is grounded via a second resistor.

8. The developing bias power unit according to claim 7, wherein a diode is interposed between said first and second resistors.

9. The developing bias power unit according to claim 1, further comprising a second control means for periodically activating and deactivating the output of said DC power source.

10. A developing bias power unit for use in an image forming apparatus accommodating a photosensitive member, said developing bias power unit applying a bias voltage to a developing sleeve confronting the photosensitive member; said developing bias power unit comprising:

a DC power source;

an electricity storage element interposed between said DC power source and said developing sleeve;

a first control means for on-off controlling said DC power source so that, when an output of said DC power source is activated, said electricity storage element is electrically charged by an output voltage of said DC power source, and a first voltage is applied to said developing sleeve, and when the output of said DC power source is deactivated, a second voltage of reverse polarity is applied to said developing sleeve by electric charge held in said electricity storage element; and a second control means for controlling so that, prior to a driving operation of said image forming apparatus, said DC power source is turned on for a given period of time, thereby electrically charging said electricity storage element, said second control means further controlling so that, after the driving operation of said image forming apparatus is started, said DC power source is turned off and the electric charge held in said electricity storage element is discharged therefrom.

11. The developing bias power unit according to claim 10, wherein said first control means controls said DC power source so that, when said developing sleeve confronts a first image region on said photosensitive member, said first voltage is applied to said developing sleeve, and when said developing sleeve confronts an area between said first image region and a second image region neighboring said first image region, said second voltage is applied to said developing sleeve.

12. The developing bias power unit according to claim 10, wherein said second voltage is equal to a voltage difference between said output voltage of said DC power source and said first voltage.

13. The developing bias power unit according to claim 10, wherein said electricity storage element is connected in parallel with a first resistor interposed between said DC power source and said developing sleeve.

14. The developing bias power unit according to claim 10, wherein an output side of said first resistor is grounded via a second resistor.

15. A developing bias power unit for use in an image forming apparatus accommodating a photosensitive member, said developing bias power unit applying a bias voltage to a developing sleeve confronting the photosensitive member; said developing bias power unit comprising:

a DC power source;

an electricity storage element interposed between said DC power source and said developing sleeve;

a first control means for on-off controlling said DC power source so that, when an output of said DC power source is activated, said electricity storage element is electrically charged by an output voltage of said DC power source, and a first voltage is applied to said developing sleeve, and when the output of said DC power source is deactivated, a second voltage of reverse polarity is applied to said developing sleeve by electric charge held in said electricity storage element; and a second control means for controlling so that, prior to a driving operation of said image forming apparatus, said DC power source is turned on for a given period of time, thereby electrically charging said electricity storage element, said second control means further controlling so that, after the driving operation of said image forming apparatus is started, said DC power source is turned off and the electric charge held in said electricity storage element is discharged therefrom; and a third control means for controlling so that the output voltage of said DC power source applied to said developing sleeve prior to the driving operation of said image forming apparatus differs from that applied to said developing sleeve at the time said developing sleeve confronts a first image region after the driving operation of said image forming apparatus is started.

16. The developing bias power unit according to claim 15, wherein said first control means controls so that, when said developing sleeve confronts said first image region on said photosensitive member, said first voltage is applied to said developing sleeve, and when said developing sleeve confronts an area between said first image region and a second image region neighboring said first image region, said second voltage is applied to said developing sleeve.

17. The developing bias power unit according to claim 15, wherein said second voltage is equal to a voltage difference between said output voltage of said DC power source and said first voltage.

18. The developing bias power unit according to claim 15, wherein said electricity storage element is connected in parallel with a Zener diode interposed between said DC power source and said developing sleeve.

19. The developing bias power unit according to claim 15, wherein an output side of said Zener diode is grounded via a resistor.

* * * * *